United States Patent [19]

Tidwell, Jr. et al.

[11] Patent Number: 5,044,692

[45] Date of Patent: Sep. 3, 1991

[54] PIVOTING TOP RAIL HEADREST

[75] Inventors: Charles J. Tidwell, Jr.; Donald R. Shutiok, both of Tupelo, Miss.

[73] Assignee: Super Sagless Corporation, Tupelo, Miss.

[21] Appl. No.: 523,399

[22] Filed: May 15, 1990

[51] Int. Cl.[5] ..... A47C 1/02

[52] U.S. Cl. ..... 297/391; 297/61; 297/396; 297/403; 297/408

[58] Field of Search ..... 297/403, 408, 391, 396, 297/61, 395, 114, 85, 86

[56] References Cited

U.S. PATENT DOCUMENTS

| | | | |
|---|---|---|---|
| 439,303 | 10/1890 | Newton | 297/61 |
| 3,836,197 | 9/1974 | Goff et al. | 297/61 |
| 3,871,705 | 3/1975 | Harrison | 297/61 |
| 4,691,961 | 9/1987 | Rogers, Jr. et al. | 297/403 |
| 4,805,960 | 2/1989 | Tacker | 297/86 |
| 4,830,429 | 5/1989 | Petitjean | 297/61 |

*Primary Examiner*—Laurie K. Cranmer
*Assistant Examiner*—Cassandra Hope
*Attorney, Agent, or Firm*—Wolf, Greenfield & Sacks

[57] ABSTRACT

A pivoting top rail headrest for an incliner seat is provided in which the top rail is secured to the top of the fixed back and spans a gap between a fixed back and a backrest when the seat is in an upright position. The top rail pivots downwardly when the body support is moved to a reclining position, and serves as a headrest extension and covers the gap by forming a generally continuous line between the moveable backrest and the top of the fixed back.

10 Claims, 2 Drawing Sheets

PIVOTING TOP RAIL HEADREST

BACKGROUND OF THE INVENTION

This invention relates to an incliner seat, and in particular an incliner seat having a pivoting top rail headrest.

Incliner seats are typically incorporated into sofas wherein an end seat of the sofa is moveable between an upright position and a reclined position as disclosed in U.S. Pat. No. 4,805,960 and incorporated herein by reference. When the incliner is in the upright position, the seat appears conventional and matches the other seating areas of the sofa. When the incliner is moved to the reclined position, the seat moves forwardly and the backrest of the seat pivots rearwardly and downwardly with respect to a fixed outer frame of the sofa. This fixed frame includes a stationary back and in the reclined position, no portion of the incliner seat and backrest moves rearward of the stationary frame. Thus, the incliner can be located close to or even against a wall, since operation of the incliner does not involve any rearward movement of the frame.

To enable the backrest to pivot rearwardly and downwardly as the seat is reclined, the top of the moveable backrest is spaced forwardly from the top of the fixed back. This spacing creates a somewhat unsightly gap which frequently is covered by a cushion which limits styling variations in incliners.

An object of the present invention is to provide an incliner in which the unsightly gap between a fixed back and a backrest is hidden from view.

Another object of the present invention is to provide an incliner with a headrest extension when the incliner is moved to the reclining position.

Yet another object of the present invention is to provide an incliner in which the front face of the fixed back of a stationary frame is covered in both the upright and reclining positions of the incliner.

A feature of the present invention is the provision of a pivotable top rail secured to the top of the fixed back spanning the gap between the backrest and fixed back when the seat is in the upright position. This top rail pivots downwardly to a second position when the moveable seat is reclined. In this second position, the top rail can serve as a headrest extension while simultaneously covering the gap as it forms a generally continuous line between the moveable backrest and the top of the fixed back.

These and other objects and features of the present invention will be better understood and appreciated from the following detailed description of one embodiment thereof, selected for purposes of illustration and read in connection with the accompanying drawing.

DETAILED DESCRIPTION OF THE PREFERRED EMBODIMENT

When the word chair is used herein, it should be understood to include all types of upholstered furniture including sofas and love seats for supporting an occupant in sitting and reclined positions. While the chair illustrated in figures does not include a footrest, it is understood that a footrest is part of the ordinary configuration.

Figure 1:
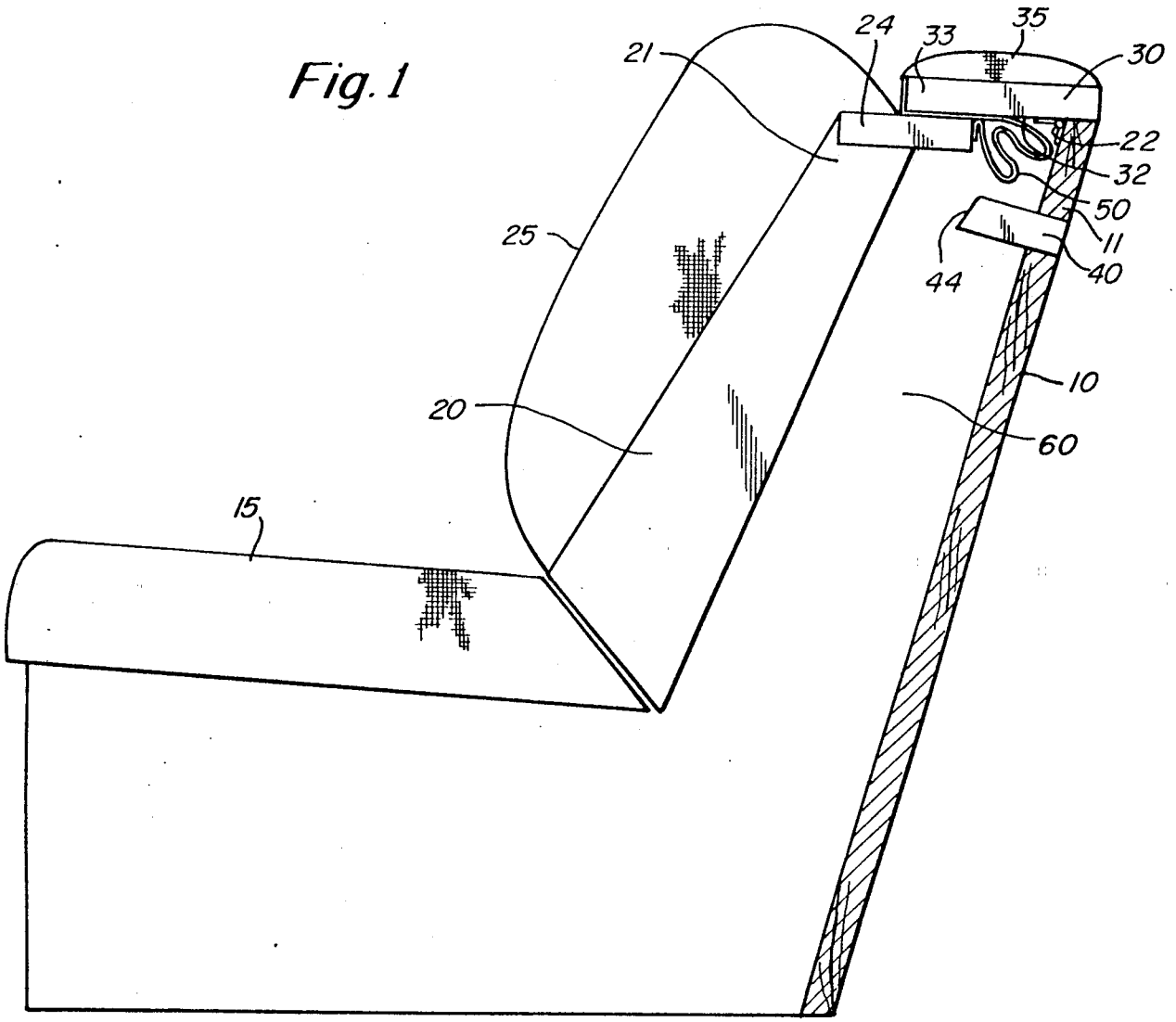
FIG. 1 is a side cross sectional view of a recliner showing the backrest, top rail and fixed back in an upright position.
Figures 2, 3:
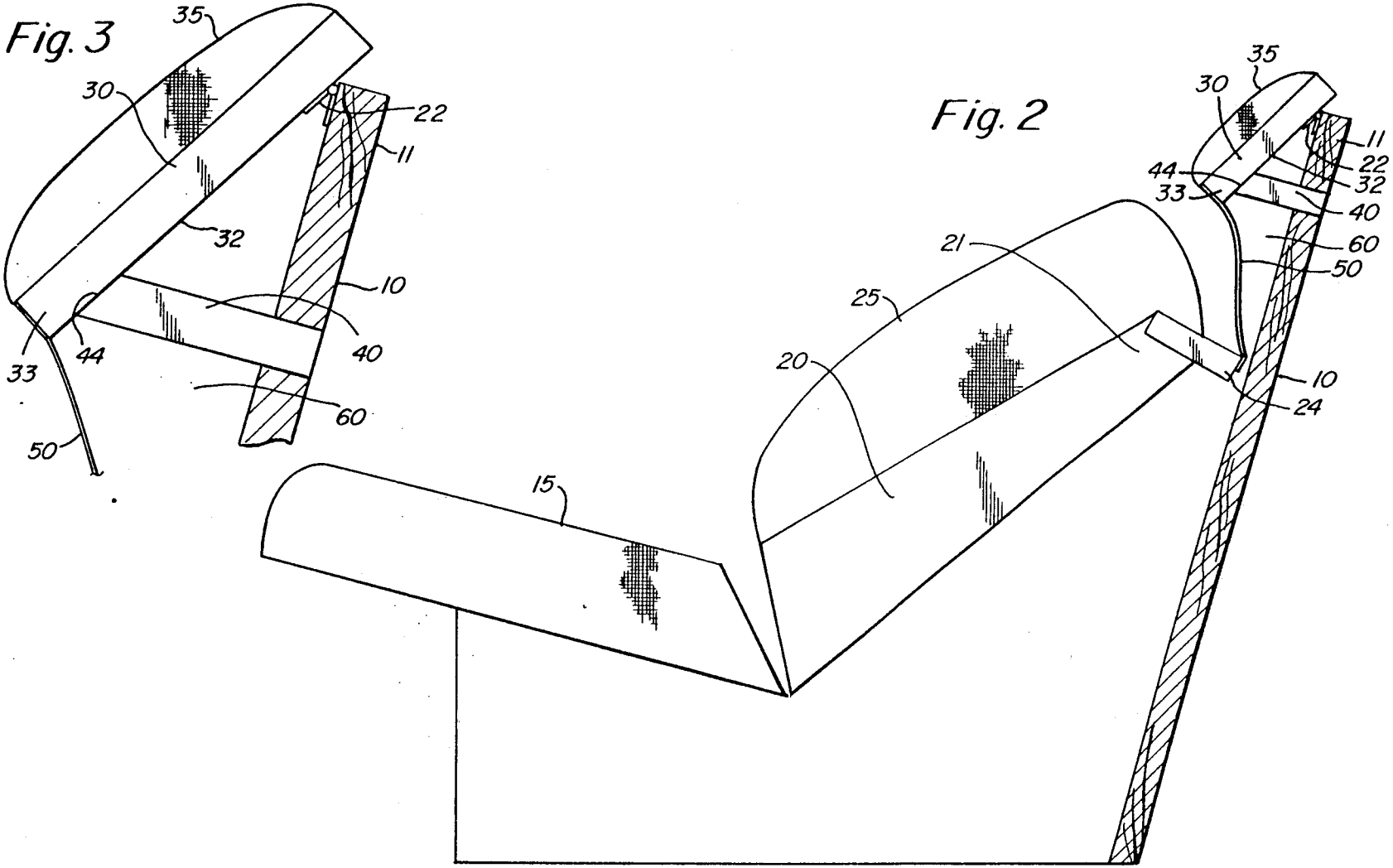
FIG. 2 is a side cross-sectional view similar to FIG. 1 showing the backrest, fixed back and top rail in a reclined position.
FIG. 3 is an enlarged side cross sectional view of the fixed back and top rail shown in FIG. 2.

The inclining mechanism is not shown in FIGS. 1–3, but rather is detailed and illustrated in U.S. Pat. No. 4,805,960, which has been incorporated herein by reference.

As shown in FIGS. 1 and 2, the stationary frame of the incliner includes a fixed back 10. The body support which rests inside of the stationary frame includes a seat 15 and a backrest 20. The body support including the backrest is moveable between an upright position, shown in FIG. 1 and a reclining position as shown in FIG. 2. The backrest 20 is positioned in front of and spaced forwardly of the fixed back 10 when the body support is in the upright position. In the upright position, the top 21 of the backrest lies adjacent the top 11 of the fixed back, and the tops 11 and 21 lie in approximately the same horizontal plane.

As shown in FIG. 3, a top rail 30 is attached by hinge 22 to the top 11 of the fixed back 10. In the illustrated embodiment, the top rail 30 extends approximately horizontally over and rests upon the top 21 of the backrest 20 so that it spans the space 60 between the backrest 20 and the fixed back 10 when the body support is in the upright position.

When the body support is moved to the reclining position shown in FIG. 2, the top rail 30 pivots downwardly about the fixed back 10 so that it is disposed above the top of the backrest 20. In this position, the top rail forms a generally continuous line with the backrest 20 and functions as a headrest. To this end, upholstery 35 is attached to the upper surface of the top rail 30, so that when the body support is in the reclining position, an occupant's head may rest comfortably against the top rail 30.

The backrest 20 includes a support rail 24 attached to the top of the backrest 20 to further support the top rail 30 in an approximately horizontal state when the body support is in the upright position, as shown in FIG. 1. This support rail 24 is attached to the top 21 of the backrest 20 so that it too has an approximately horizontal orientation when the body support is in the upright position.

A support 40 extends into the space 60 from the fixed back 10 to provide support for the top rail 30 when the body support is in the reclining position and the top rail 30 is pivoted downward so as to serve as a headrest. More particularly, the support 40 extends transversely from the fixed back 10 and has a front surface 44 which is angled to provide the correct orientation for the top rail 30. The support 40 is located above the top of the backrest 20 when the body support is in the reclining position. Thus, when the top rail 30 pivots downwardly from the top of the fixed back 10, the rear surface 32 of the top rail 30, near the free front end 33 thereof, rests against the front surface 44 of the support 40.

As shown in FIG. 2, a fabric cover 50 extending from the front end 33 of the top rail 30 to the top of the backrest 20 covers the front face of the fixed back 10 when the backrest is in the reclining position. The fabric cover 50 normally would be made of the same fabric covering the body support to provide the proper aesthetic look. When the chair is in the upright position, the fabric cover 50 folds behind the backrest 20 so as to be effectively hidden from view.

When the body support is moved to the reclining position shown in FIG. 2, the upholstery 25 attached to the front of the backrest 20 and upholstery 35 attached to the upper surface of the top rail 30 are in substantial alignment with one another. Thus, an occupant of the chair can comfortably recline against the upholstery on the front surface of the backrest 20 with his head lying against the upholstery on the top surface of the top rail 30.

In operation, when the body support is in its upright position, the top rail 30 will extend approximately horizontally across the tops 11 and 21 of the fixed back 10 and the backrest 20, respectively, thus covering the gap 60. When the occupant of the incliner moves the body support to the reclining position, the top rail 30 pivots downwardly under the influence of gravity so that it rests against the front inclined surface 44 of the support 40 attached to the fixed back 10. In this position, the head of an occupant of the chair can rest comfortably against the upholstered surface of the top rail 30.

The fabric cover 50 which extends from the front portion of the top rail 30 to the top 21 of the backrest 20 folds upon itself and extends into the gap 60 when the body support is in the upright position as shown in FIG. 1. However, when the body support is moved to the reclining position the cover 50 unfurls so that it extends downwardly and covers the front face of the fixed back 10. Thus, the pivoting top rail headrest of the present invention covers the unsightly gap 60 in both the upright and reclining positions.

As the body support is returned to the upright position from the reclining position, the support rail 24, which is attached to the top 21 of the backrest 20, moves upwards and contacts a portion of the rear surface 32 of the top rail 30 near the free front end 33, which extends below the support 40. The support rail 24 thus causes the top rail 30 to pivot upward about the top 11 of the fixed back 10 due to the continued upward movement of the backrest 20. When the body support is once again in the upright position, the support rail 24 is once again oriented approximately horizontally and supports the top rail 30 in a similar horizontal plane, as shown in FIG. 1.

Having described this invention in detail, those skilled in the art will appreciate that numerous modifications may be made thereof without departing from the spirit of the invention. Therefore, I do not intend to limit the scope of this invention to the specific embodiment illustrated and described. Rather its scope is to be determined by the appended claims and their equivalents.

I claim:

1. An incliner comprising:

a stationary frame including a fixed back, a body support including a seat and a backrest movable between upright and reclining positions and disposed within the stationary frame, said backrest being positioned in front of and spaced from the fixed back with the top of the backrest being adjacent the top of the fixed back when the body support is in the upright position and below the top of the fixed back when the body support is in the reclining position, a top rail, having a front end and a rear end, wherein the rear end is hinged to the top of the fixed back so that the top rail is oriented in a first position extending over and resting on the top of the backrest and spanning the space between them when the body support is in the upright position and oriented in a second position hanging downwardly from the fixed back and disposed above the top of the backrest when the body support is in the reclining position so as to serve as a headrest, with the front end of said top rail disposed above and closest to the top of the backrest.

2. An incliner as defined in claim 1, wherein a top rail support is mounted on the fixed back below the top thereof and above the top of the backrest when in the reclining position for supporting the top rail in a headrest position.

3. An incliner as recited in claim 2, wherein said top rail support has a front surface which is angled to orient said top rail in substantial alignment with the backrest when said body support is moved to said reclining position.

4. An incliner as defined in claim 2, wherein said top rail support extends into said space between said fixed back and said backrest.

5. An incliner as set forth in claim 1, wherein a fabric cover is connected to the front end of the top rail and the top of the backrest for covering the front face of the fixed back when the backrest is in the reclining position.

6. An incliner as set forth in claim 1, wherein the backrest further comprises a support rail attached to the top of the backrest for supporting top rail when said body support is in the upright position.

7. An incliner as set forth in claim 6, wherein said support rail engages said top rail when said body support is moved from said reclining position to said upright position to pivot said top rail about the top of the fixed back to return said top rail to the first position.

8. An incliner as recited in claim 1, wherein said top rail is upholstered.

9. An incliner as recited in claim 1, further comprising upholstery disposed on said backrest, wherein said upholstery on said backrest and said top rail are in substantial alignment with one another when said body support is in said reclining position.

10. An incliner as recited in claim 1, wherein said top rail extends approximately horizontally in said first position.

* * * * *